US005795191A

United States Patent [19]

Preputnick et al.

[11] Patent Number: 5,795,191

[45] Date of Patent: Aug. 18, 1998

[54] CONNECTOR ASSEMBLY WITH SHIELDED MODULES AND METHOD OF MAKING SAME

[76] Inventors: George Preputnick, 517 Blanchester Rd., Harrisburg, Pa. 17112; James Lee Fedder, 105 Appaloosa Way, Etters, Pa. 17319; Scott Keith Mickievicz, 534 Westbrooke Dr., Elizabethtown, Pa. 17022; Richard Nicholas Whyne, 5113 Inverness Dr., Mechanicsburg, Pa. 17055

[21] Appl. No.: 882,795

[22] Filed: Jun. 26, 1997

Related U.S. Application Data

[63] Continuation-in-part of Ser. No. 714,024, Sep. 11, 1996.

[51] Int. Cl.[6] ..... H01R 13/648

[52] U.S. Cl. ..... 439/608; 439/108

[58] Field of Search ..... 439/607–610, 439/108, 79; 29/856, 857, 858

[56] References Cited

U.S. PATENT DOCUMENTS

| | | | |
|---|---|---|---|
| 4,846,727 | 7/1989 | Glover et al. | 439/608 |
| 4,952,172 | 8/1990 | Barkus et al. | 439/532 |
| 4,975,069 | 12/1990 | Fedder et al. | 439/101 |
| 4,975,084 | 12/1990 | Fedder et al. | 439/608 |
| 5,046,960 | 9/1991 | Fedder | 439/108 |
| 5,066,236 | 11/1991 | Broesteeg | 439/79 |
| 5,104,341 | 4/1992 | Gilissen et al. | 439/608 |
| 5,224,867 | 7/1993 | Ohtsuki et al. | 439/108 |
| 5,403,206 | 4/1995 | McNamara et al. | 439/608 |
| 5,496,183 | 3/1996 | Soes et al. | 439/79 |

FOREIGN PATENT DOCUMENTS

| | | | |
|---|---|---|---|
| 0 486 298 A1 | 11/1991 | European Pat. Off. | H01R 23/68 |
| 0 560 550 A2 | 8/1993 | European Pat. Off. | H01R 13/648 |

OTHER PUBLICATIONS

International Search Report, Corresponding Application PCT/US97/15881: Mailed Dec. 2, 1997 (Three Pages).

*Primary Examiner*—Hien Vu
*Attorney, Agent, or Firm*—Katherine A. Nelson

[57] ABSTRACT

An electrical connector assembly (10) includes an insulating housing (12) and assembled thereto a plurality of terminal modules (30) and electrically conductive shields (60) therebetween. Each terminal module (30) includes an alternating pattern of first and second contacts (42,44), the intermediate portions (50) thereof being formed at selected locations therealong such that the intermediate portions of the first contacts (42) are encapsulated in the insulating web (54) proximate a first side surface (32) and the intermediate portions of the second contacts (44) are encapsulated in the web (54) proximate the second major surface (34) of the module. In the assembled connector (10), the first contacts (42) are spaced more closely to shield (60) along surface (32) and the second contacts (44) are spaced more closely to shield (60) along surface (34) thereby assuring primary coupling between each signal contact (40) and a respective ground shield (60) rather than to an adjacent signal contact (40).

14 Claims, 11 Drawing Sheets

CONNECTOR ASSEMBLY WITH SHIELDED MODULES AND METHOD OF MAKING SAME

RELATED APPLICATION

This application is a continuation-in-part of U.S. patent application Ser. No. 08/714,024, filed Sep. 11, 1996 issued Feb. 20,1998.

FIELD OF THE INVENTION

This invention relates to electrical connector assemblies having shielded modules, serving to shield columns of adjacent terminals from crosstalk.

BACKGROUND OF THE INVENTION

It is common, in the electronics industry, to use right angled connectors for electrical connection between two printed circuit boards or between a printed circuit board and conducting wires. The right angled connector typically has a large plurality of pin receiving terminals and at right angles thereto, pins (for example compliant pins), that make electrical contact with a printed circuit board. Post headers on another printed circuit board or a post header connector can thus be plugged into the pin receiving terminals, making electrical contact therebetween. The transmission frequency of electrical signals through these connectors is very high and requires not only matched impedance with the circuit board and balanced capacitance of the various contacts within the terminal modules to reduce signal lag and reflection but also shielding between rows of terminals to reduce crosstalk.

Impedance matching of terminal contacts has already been discussed in U.S. Pat. Nos. 5,066,236 and 5,496,183. Cost effective and simple designs of right angle connectors have also been discussed in these patents, whereby the modular design makes it easy to produce shorter or longer connectors without redesigning and tooling up for a whole new connector, but only producing a new housing part into which a plurality of identical terminal modules are assembled. As shown in '236 patent, shielding members can be interposed between adjacent terminal modules. The modules disclosed in these patents are manufactured by stamping a lead frame in the selected shape and overmolding the lead frame in selected areas with insulative material to form an insulative web that holds the contacts in the desired arrangement. The shape of the contacts and the thickness of the web are controlled to provide impedance matching between the contacts of the modules. The contacts are spaced in the web such that they are equidistant from the adjacent shields in the assembled connector.

SUMMARY OF THE INVENTION

The object of this invention is to provide an improved terminal module having greater impedance control for carrying high speed signals in high density connectors.

Another object of this invention is to provide a connector having increased coupling between the signal contacts and the associated ground shield and to decrease the coupling between active signal lines.

A further object of this invention, is to provide a continuous shield that extends between each column of terminals and along substantially the entire length of the contacts from the mating interface to the board interface and makes a reliable and effective electrical connection between a grounding circuit and the shield.

An additional object of this invention is to provide an efficient and cost effective method of manufacturing the assemblies.

One object of this invention has been achieved by providing an electrical connector assembly that includes an insulating housing and assembled thereto a plurality of terminal modules and electrically conductive shields therebetween. Each terminal module has a plurality of contacts including a mating contact portion, a conductor connecting portion and an intermediate portion therebetween with at least some of the intermediate portions encapsulated in an insulative web. Each of the modules further has an electrically conductive shield mounted thereto, the connector assembly being characterized in that: each terminal module includes an alternating pattern of first and second contacts, the intermediate portions of the first and second contacts being formed at selected locations therealong such that the intermediate portions of the first contacts are encapsulated in the insulating web proximate a first major side surface of the module and spaced from an opposed second major surface thereof and the intermediate portions of the second contacts are encapsulated in the web proximate the second major surface of the module and spaced from the first major surface thereof. Upon assembling the terminal modules and conductive shields therebetween into the insulating housing, the intermediate portions of the first contacts are spaced more closely to a first ground shield along the first major surface and the intermediate portions of the second contacts are spaced more closely to a second ground shield along the second major surface thereby assuring primary coupling between each signal contact and a respective ground shield rather than to an adjacent signal contact.

Another object of the invention has been achieved by minimizing the amount of dielectric material between and around the signal contacts to reduce the capacitance of the contacts and thereby reduce coupling between the signal contacts and noise.

A further object has been achieved in a further embodiment of the terminal module wherein each terminal module includes complementary first and second half-modules and an alternating pattern of first and second contacts. The intermediate portions of the first and second contacts are formed at selected locations therealong such that the intermediate portions of the first contacts are encapsulated in the insulating web of the first half-module defining a first major side surface of the module and the intermediate portions of the second contacts are encapsulated in the web of the second half-module defining the second major surface of said module. The first and second half-modules are assembled together and the conductive shields are placed between adjacent terminal modules. The resultant assembly is then inserted into the insulating housing. The intermediate portions of the first contacts are spaced more closely to a first ground shield along the first major surface and the intermediate portions of the second contacts are spaced more closely to a second ground shield along the second major surface, thereby assuring primary coupling between each signal contact and a respective ground shield rather than to an adjacent signal contact.

Embodiments of the invention will now be described with reference to the accompanying drawings.

DETAILED DESCRIPTION OF EMBODIMENTS OF THE INVENTION

Figure 1:
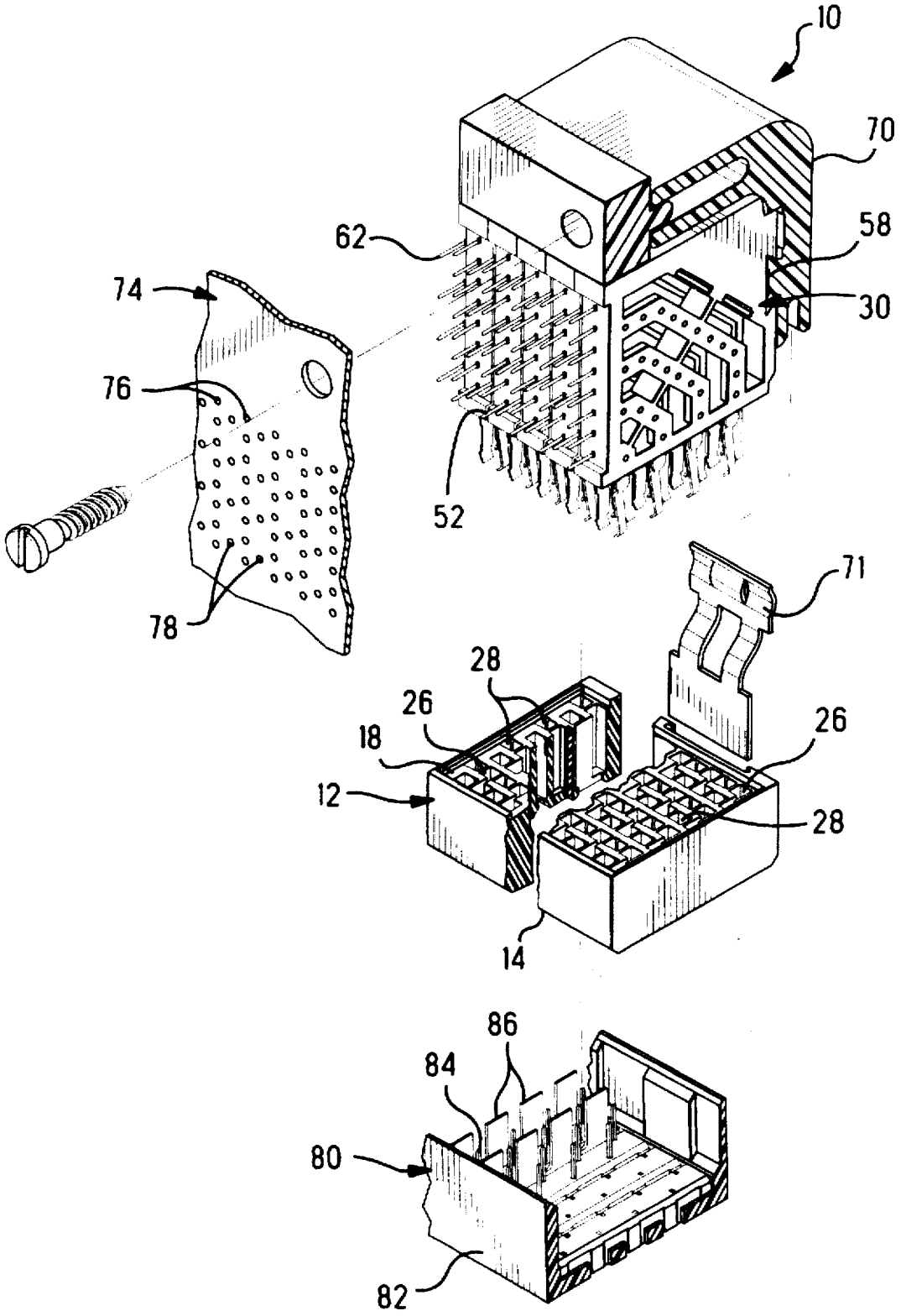
FIG. 1 is an isometric view of a portion of a connector having a plurality of terminal modules made in accordance with the invention disposed therein with the module and shield assembly exploded from the housing and from a backplane and a fragmentary portion of the mating connector.
Figure 6:
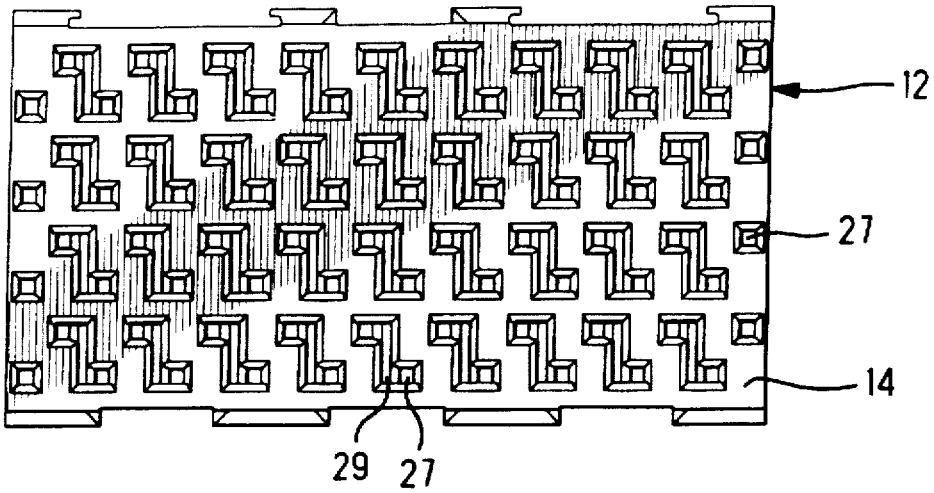
FIG. 6 is a plan view of the mating face of the receptacle connector of the present invention.
Figure 7:
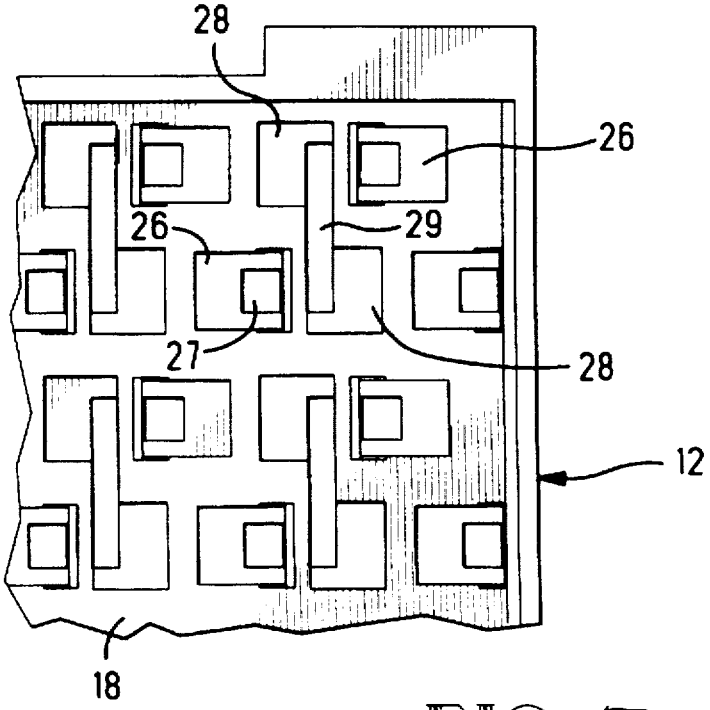
FIG. 7 is an enlarged fragmentary portion of the connector assembly face.

FIG. 1 illustrates a connector 10 having a housing 12 and a plurality of shielded terminal modules 30 made in accordance with the invention. Connector 10 is shown exploded from a circuit board or backplane 74. Housing 12 includes a mating face 14, a mounting face 16, an assembly face 18 and a plurality of signal contact receiving passageways 26 and a plurality of ground contact receiving passageways 28 extending from the assembly face 18 to the mating face 14. Signal contact passageway 26 includes aperture 27 at the mating face 14 for receiving complementary signal contact 84 of the mating connector 80. Ground contact passageway 28 includes slot 29 at the mating face 14 for receiving complementary a ground contact 86 of the mating connector 80, as best seen in FIGS. 6 and 7.

Mating connector 80 includes a housing 82 having a plurality of signal contacts 84 arranged in a staggered array complementary to the signal contact array of connector 10. Housing 82 further includes a plurality of ground blades 86 adapted to be received between ground contacts 62 of connector 10. Mating connector 80 is mountable to a circuit board (not shown) and is of the type disclosed in U.S. Pat. No. 4,975,084.

Figure 2:
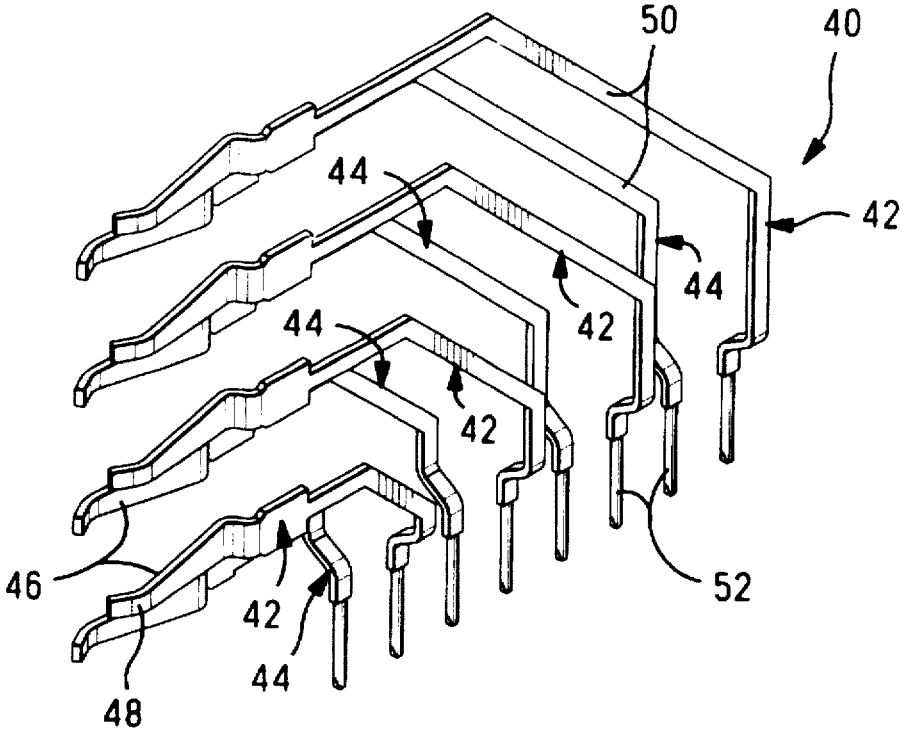
FIG. 2 is an isometric view of the arrangement of the formed contacts in a terminal module prior to encapsulation and with a carrier strip removed for purposes of illustration.
Figure 3:
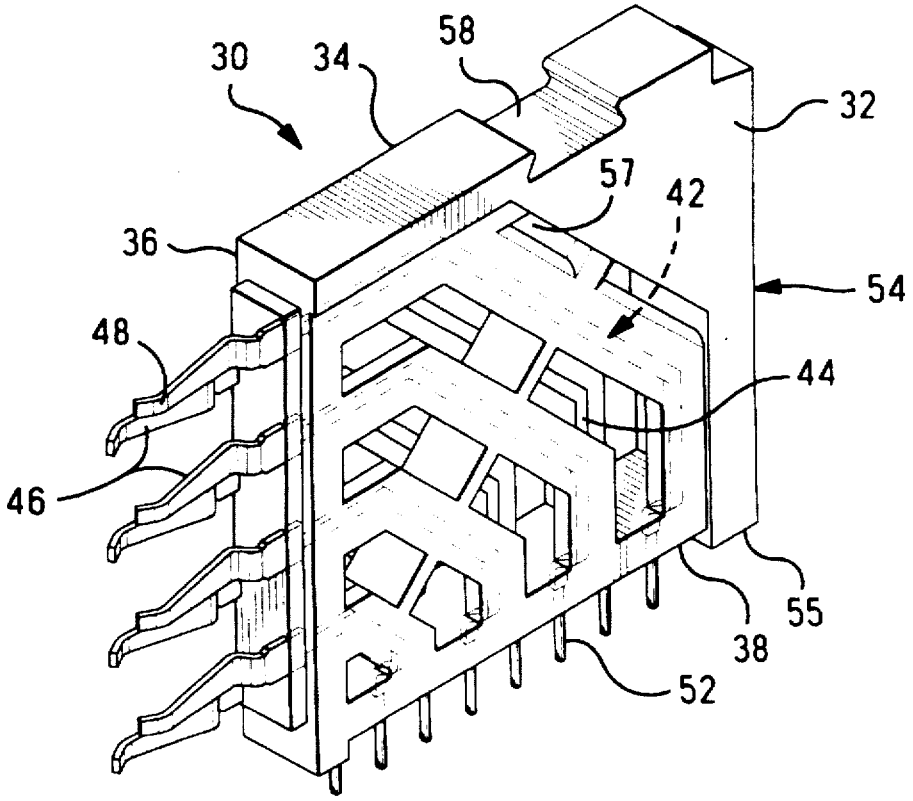
FIG. 3 is an isometric view of a terminal module after encapsulation of the contacts of FIG. 2 and illustrating the mating portions of the contacts.
Figure 4:
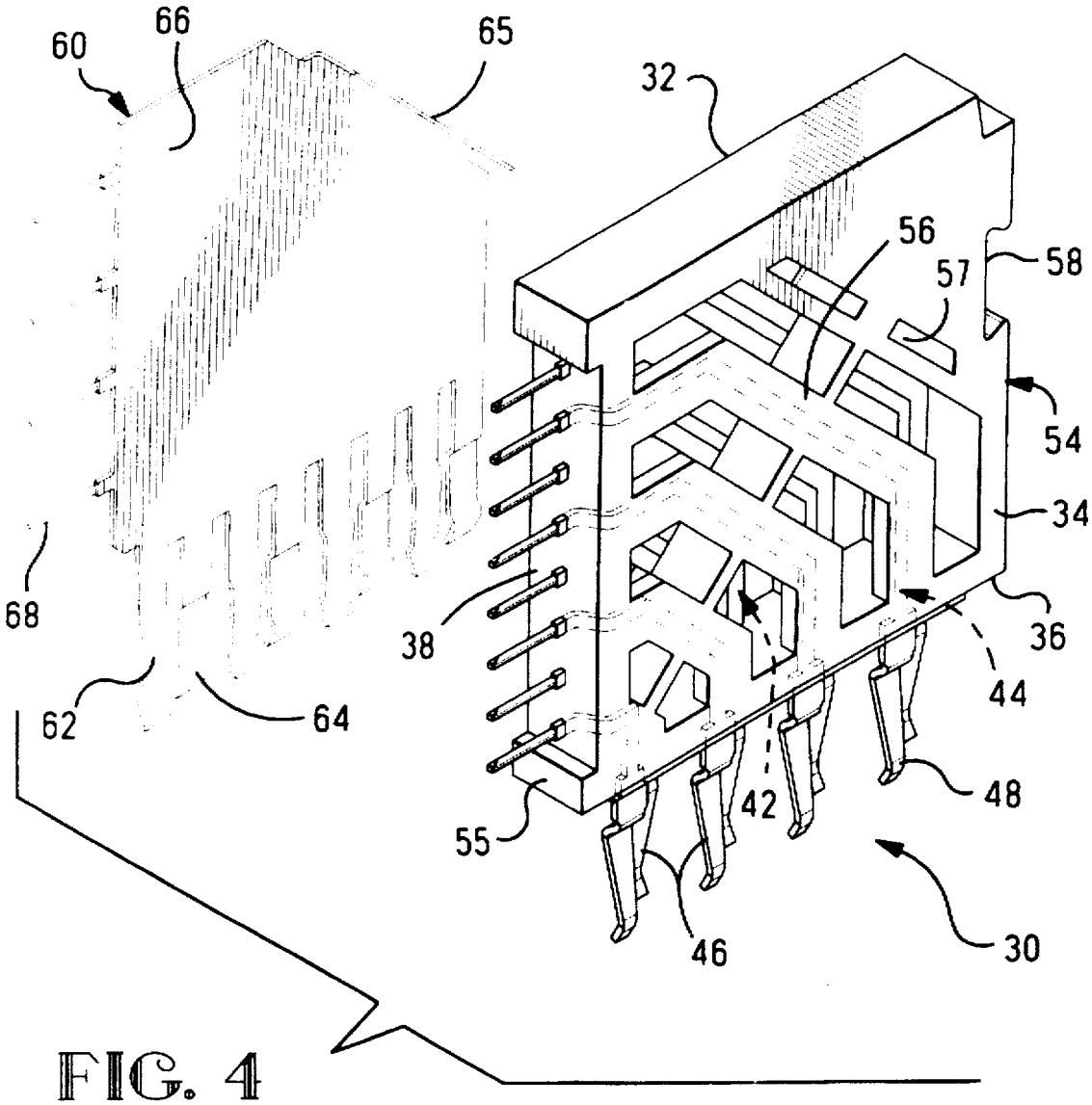
FIG. 4 is an isometric view of the terminal module of FIG. 3 as viewed from the board mounting portions.
Figure 5:
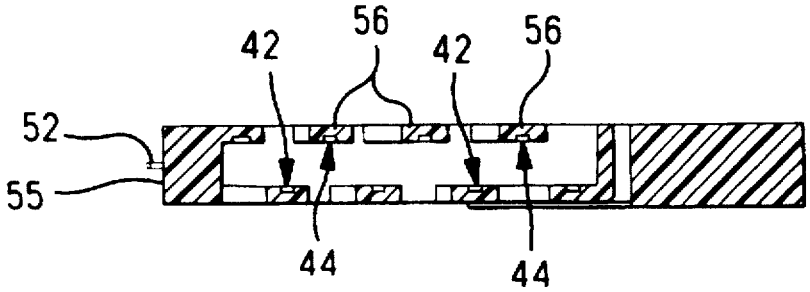
FIG. 5 is a sectional view of the terminal module taken along a line parallel to the diagonal support structure of the module and illustrating the position of the contacts in the module.

Referring now to FIGS. 2 through 4, each terminal module 30 has opposed first and second major sides 32, 34, a leading or forward edge 36 and a board mounting edge 38. Module 30 includes a plurality of contacts referred to generally as 40, which include first and second embodiments 42,44. Each contact 40 includes a mating contact portion 46 having a contact surface 48 thereon, a board mounting portion 52 and an intermediate portion 50 extending therebetween. First and second contact embodiments 42,44 differ from each other to the extent that the intermediate portion 50 is formed or bent in opposite directions to place the respective intermediate portions 50 proximate one of the opposed major sides 32,34 of the terminal module 30, as more fully explained below. At least some of each of the intermediate portions 50 of the respective terminals 40 is encapsulated in an insulating web 54 with a portion of insulation 56 surrounding respective intermediate contact portions 50, as best seen in FIGS. 3 and 4. FIGS. 3, 4 and 5 also show that the intermediate portions 50 of first contacts 42 lie in a first common vertical plane are closer to the first major side 32 and the intermediate portions 50 of second contact embodiment 44 lie in a second common vertical plane spaced from the first vertical plane and are adjacent the second major side 34. The first and second vertical planes are parallel to each other. In the embodiment shown, the contact mating portions 46 of the first contacts 42 are staggered with respect to those of the second contacts 44 and the board mounting or conductor connecting portions 52 lie essentially in the same plane. FIG. 4 further shows a ground shield 60 exploded from module 30.

The structure of the terminal modules 30 lends itself to automated manufacturing and assembly processes. The contacts are stamped in a lead frame configuration, the intermediate portions 50 are formed in an alternating array of first and second contact embodiments 42,44 and the lead frame is then overmolded with the web material 54. As shown in these embodiments the board connecting portions 42 are shown as solder tails but compliant pins or other configurations may also be used.

The structure of the illustrating overmolded web 56 is best understood by referring to FIGS. 3 and 4. Web 54 includes a plurality of thin strips 56 of plastic surrounding substantially three sides of the corresponding intermediate terminal portions 50. Web 54 is generally rectangular in shape and includes standoffs 55 approximate the board mounting surface and further includes notches 58 along outer surface for being secured to a stiffener 70 in the assembly of connector 10 as shown in FIG. 1. Stiffener 70 is secured to housing 12 by clips 71 and is of the same type shown in U.S. Pat. No. 4,952,172.

The position of the respective intermediate portions 50 of first and second contact embodiments 42,44 in the illustrating webs strips 56 is best seen by referring to the sectional view of FIG. 5. The intermediate portions 50 of the first contacts 42 are spaced more closely to the first major side and the intermediate portions 50 of the second contacts 44 are spaced more closely to the second major side.

As shown in FIGS. 4 and 5, because of the right angled configuration of the terminal module 30, the intermediate contact portions 40 have different lengths, the different lengths of the contacts mean that they have different capacitance, which is undesirable for high speed data transmission, this being explained in more detail in the aforementioned patents. Air pockets are provided in modules 30 at selected locations to compensate for the differences in the lengths of the contacts. The air pockets serve to decrease the dielectric constant between adjacent contacts, and match the capacitance of the intermediate contact portions with respect to each other, for the same reasons as disclosed in the aforementioned documents. As a result, the propagation delay for the signal to travel along the contact is delayed for selected contacts to substantially equalize the time for the signals to travel through the module along any one of the contacts. It is to be noted that the board connecting portions 52 lie in a common plane even though the corresponding intermediate portions 50 and mating portions 46 do not lie in the same plane. The mating portions 46 are proximate the same major side of module 30 as the associated intermediate portion 50.

Referring now to FIG. 4, ground shield 60 is a substantially planar member having a contact mating portion 62 comprising a plurality of cantilevered arms 63 formed having contact surfaces 64 thereon, a planar body member 66 and a plurality of board mounting sections 68 extending along board mounting edge thereof. Ground shield 60 is dimensioned to be placed between adjacent terminal modules 30 as shown in FIG. 1. Preferably a shield is secured to each module 30 with tabs 65 being inserted into slots 57 of the insulating web. The shields 60 essentially cover the complete surface of one major side of module 30, as seen in FIG. 4.

Figure 8:
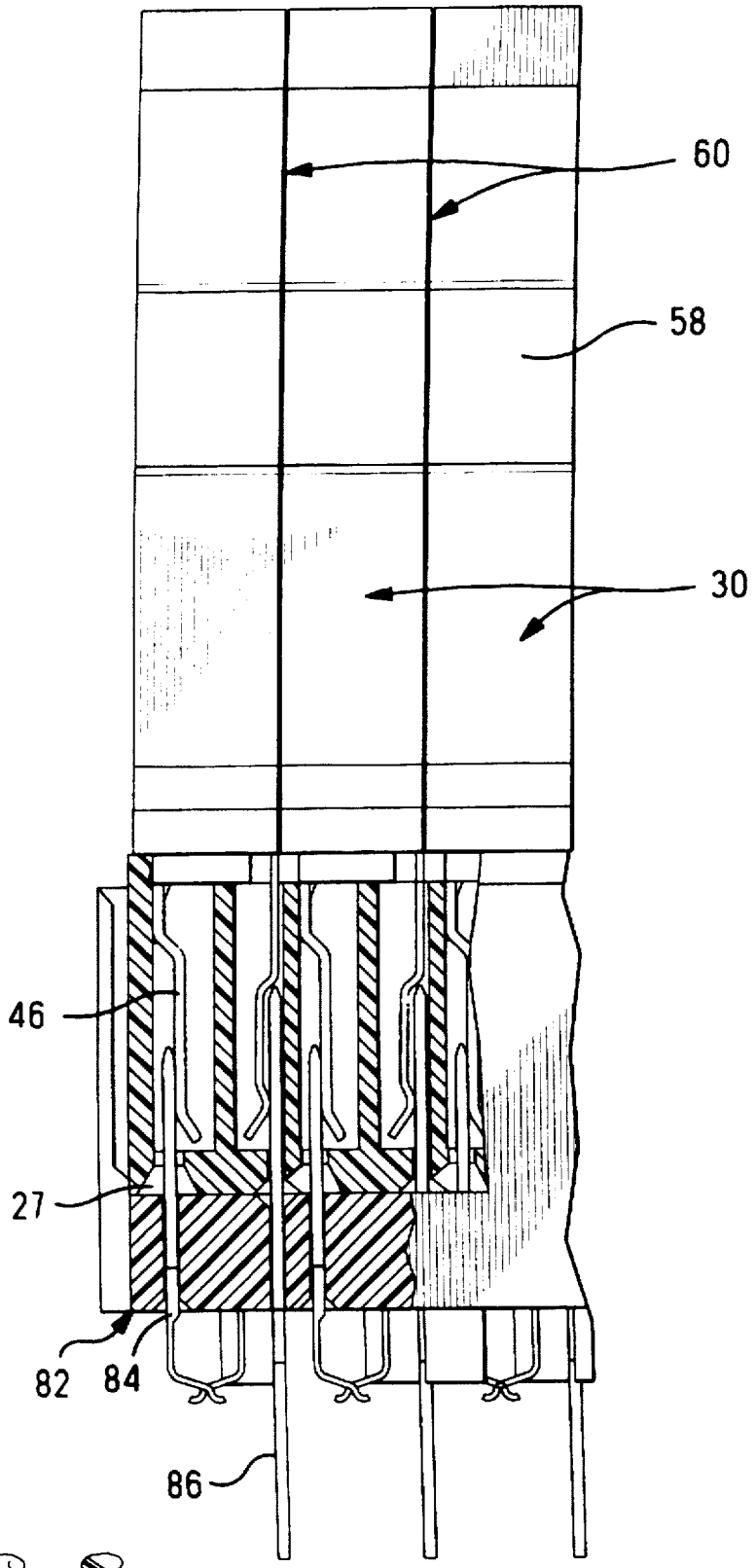
FIG. 8 is a top plan view of the receptacle connector partially broken away and illustrating the signal and ground contact mating portions being mated by complementary contacts of a mating connector.

FIG. 6 illustrates the mating face 14 and FIG. 7 illustrates the assembly face 18 of connector housing 12 wherein the signal contact receiving passageways 26 are disposed at diagonally opposite ends of the ground contact receiving passageways 28. FIG. 8 illustrates a fragmentary portion of a connector housing 12 wherein the signal pins 84 of the mating connector 80 engage respective contact mating portions 46 of the signal contacts 40 and the respective ground tabs 86 of the mating connector 80 engage the contact mating portion 62 of the ground contact. As can be seen by these Figures the signal contact 46 is closely spaced to an associated ground shield 60 and is more closely associated with shield 60 than with the corresponding signal contact 40 that is adjacent to it in the terminal module 30. The close proximity of the signal contact 40 to a respective ground shield 60 assures primary coupling between each of the signal contacts and a respective ground shield rather than to an adjacent signal contact thus lessening problems associated with crosstalk and noise.

The terminal modules 30 and ground shield 60 of FIG. 1 are then assembled side by side to the back of housing modules 12 as disclosed in U.S. Pat. Nos. 5,066,236 and 5,496,183, whereby the pin receiving end 38 is for receiving a complementary male pin terminal and the connecting terminal end 52 is for electrical contact with through holes of a printed circuit board. In the embodiment shown, the respective terminal ends of 52 of the signal contacts are received in through-holes 76 of circuit board 74 and board mounting sections 68 of ground shield 60 are received in through-holes 78 of board 74, as shown in FIG. 1.

Figure 9:
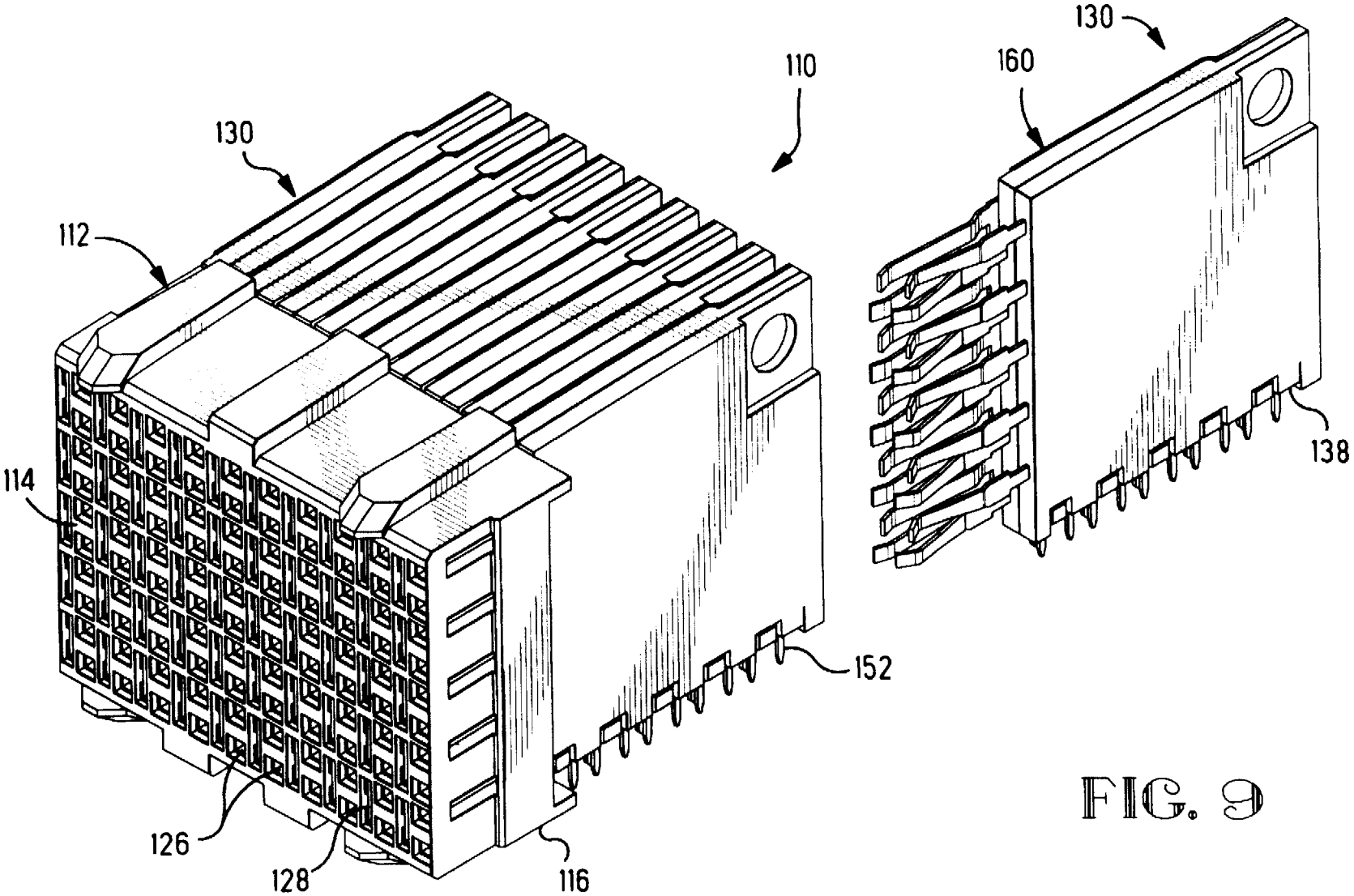
FIG. 9 is an isometric view of a portion of another embodiment of a connector having a plurality of terminal modules made in accordance with the invention. disposed therein with the module and shield assembly exploded from the housing.
Figure 10:
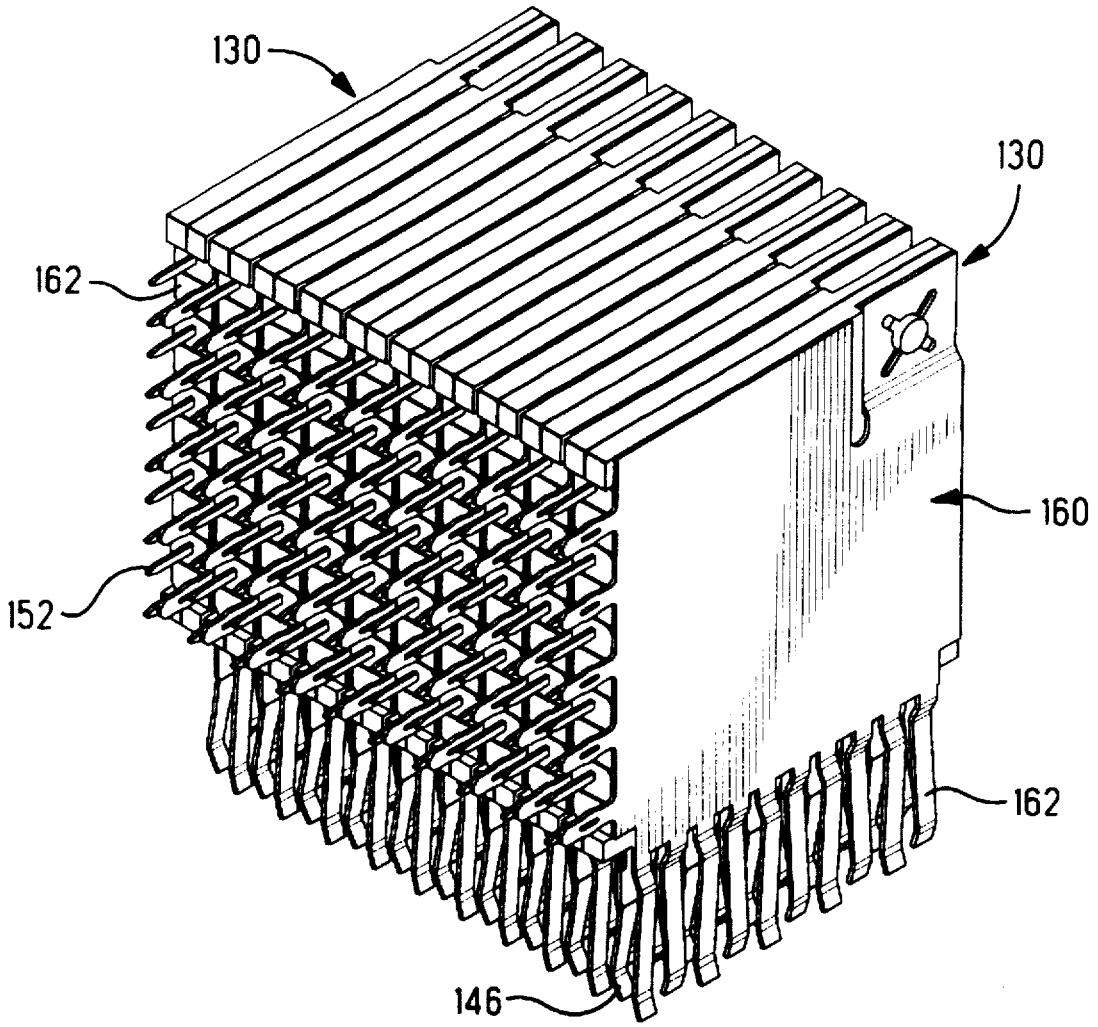
FIG. 10 is an isometric view of the connector portion of FIG. 9 with the modules exploded from the connector housing.
Figure 10:
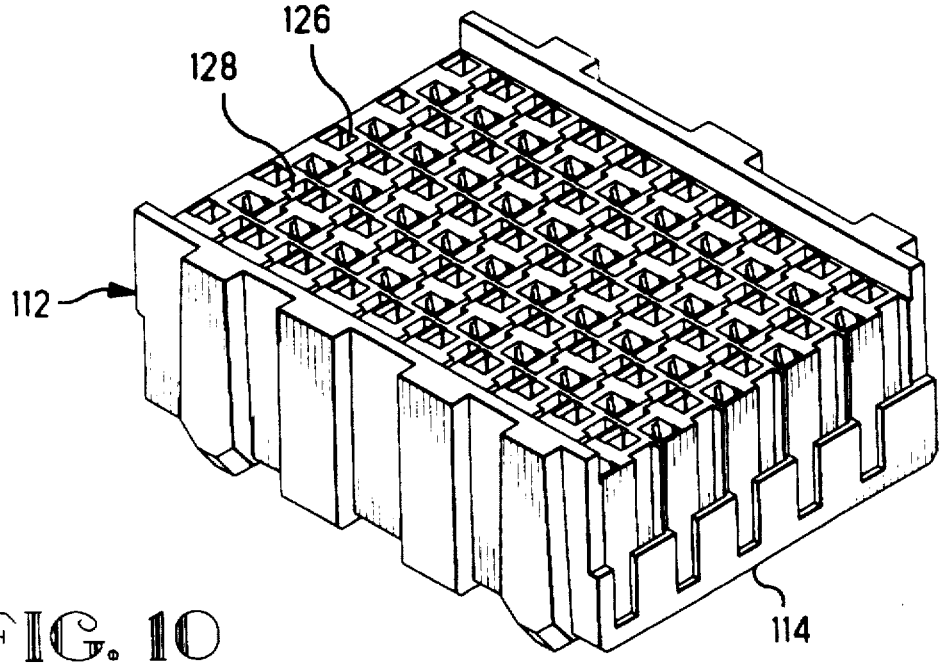

FIGS. 9 and 10 illustrate another connector embodiment 110 having a housing 112 and a plurality of shielded terminal modules 130 made in accordance with the invention. Housing 112 includes a mating face 114, a mounting face 116, a plurality of signal contact receiving passageways 126 and a plurality of ground contact receiving passageways 128. Housing 112 is configured in substantially the same manner as housing 12, previously discussed. For purposes of illustration, connector 110 has ten rows of signal contacts, while connector 10 has eight rows of contacts. Connector 110 is adapted to mate with a complementary connector similar to connector 80, previously described.

Figure 11:
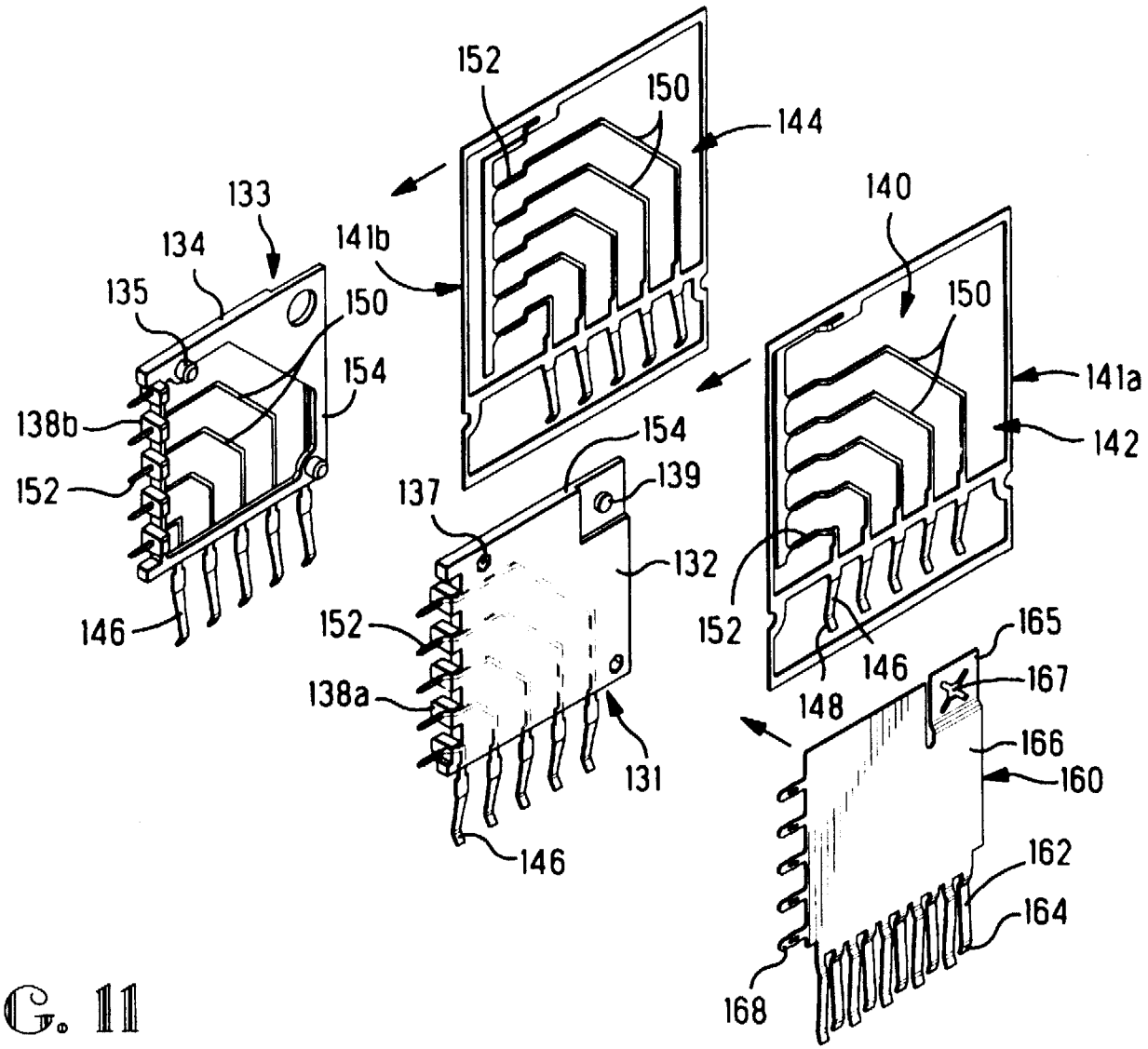
FIG. 11 is an exploded view of a terminal module of FIG. 9 and ground plane assembly illustrating the method of making the module.
Figure 12:
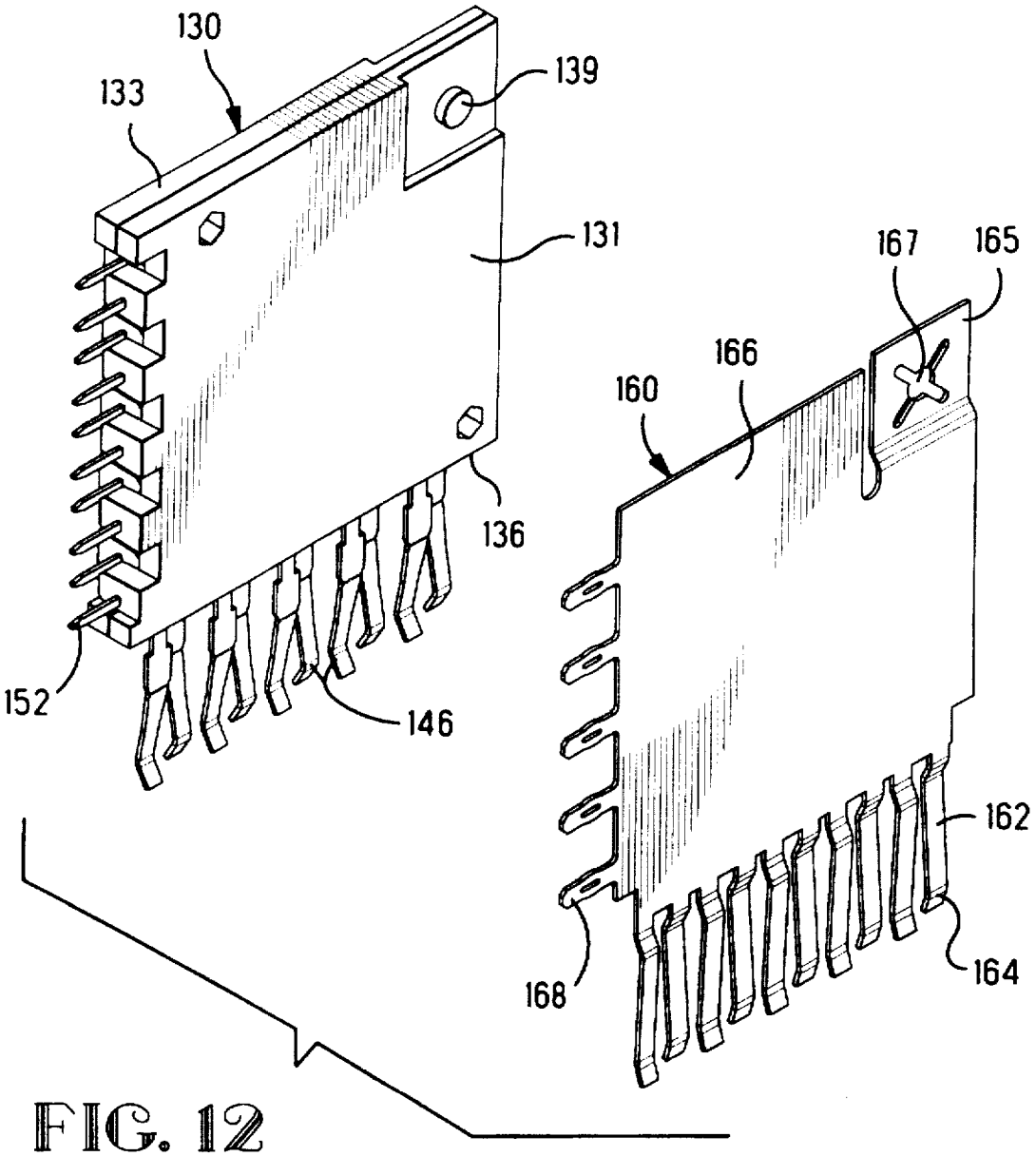
FIG. 12 is an isometric view of a terminal module after encapsulation of the contacts of FIG. 11 and having the ground shield exploded therefrom and illustrating the board mounting face of the module.

Referring now to FIGS. 11 through 15, each terminal module 130 includes complementary first and second half-modules 131,133 respectively. The assembled module 130 has opposed first and second major sides 132, 134, a leading or forward edge 136, a board mounting edge 138 and a plurality of contacts 140, which include first and second groups 142,144. Each contact 140 includes a mating contact portion 146 having a contact surface 148 thereon, a board mounting portion 152 and an intermediate portion 150 extending therebetween. First half-module 131 includes first contact group 142 and second half-module 133 includes second contact group 144. The first and second contact groups 142,144 differ from each other to the extent that each intermediate portion 150 of first group 142 is formed or bent proximate the board mounting portion 152 in an opposite direction to the intermediate portion 150 of the contacts in second group 144. As illustrated in these Figures, the contacts in the respective groups alternate in the assembled module 130. In the embodiment illustrated, the first contact group 142 includes the contacts for rows one, three, five, seven and nine and the second contact group 144 includes the contacts for rows two, four, six, eight, and ten in assembled connector 110. The location of the respective bends are selected such that the majority of the respective intermediate portions 150 are proximate one of the opposed major sides 132,134 of the terminal module 130 and upon assembly of module 131, the corresponding board mounting portions 152 extend substantially from the middle of the board mounting edge 136, as more fully explained below. At least some of each of the intermediate portions 150 of the respective terminals 140 is encapsulated in an insulating web 154, as best seen in FIGS. 11 and 12. FIGS. 11 and 12 also show that the intermediate portions 150 of first group of contacts 142 lie in a first common vertical plane are closer to the first major side 132 and the intermediate portions 150 of the second group of contacts 144 lie in a second common vertical plane spaced from the first vertical plane and are adjacent the second major side 134. The first and second vertical planes are parallel to each other. In the embodiment shown, the contact mating portions 146 of the first contacts 142 are staggered with respect to those of the second contacts 144 and the board mounting or conductor connecting portions 152 lie essentially in the same plane. FIG. 12 further shows a ground shield 160 exploded from module 130.

The structure of the terminal modules 130 lends itself to automated manufacturing and assembly processes. Each group of contacts is stamped in a lead frame configuration 141*a*,141*b* with the intermediate portions 150 being formed in the selected direction. Each lead frame is then overmolded with the web material 54 to form one of the half-modules 131 or 133. As shown in these embodiments the board connecting portions 152 are shown as solder tails but compliant sections or other configurations may also be used.

Figure 13:
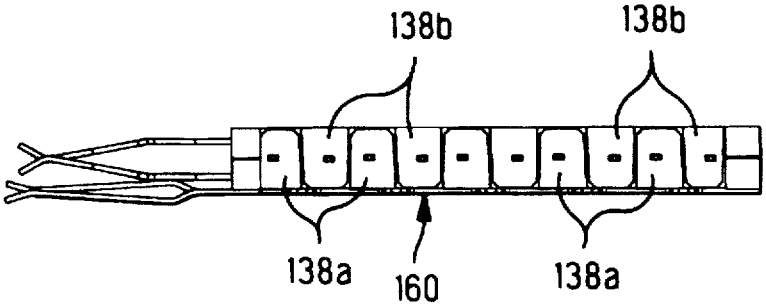
FIG. 13 is a plan view of the board mounting face of the terminal module of FIG. 12 illustrating the interleaving of the two half-modules therealong.

The structure of the illustrating overmolded web 156 is best understood by referring to FIGS. 11 and 12. Web 154 includes a thin substantially solid wall defining one of the major sides 132,134 of module 130. The wall surrounds the intermediate terminal portions 150 sufficiently to hold the intermediate contacts position accurately and stabily in the half module. Each web 154 is generally rectangular in shape with each side including one/half the thickness of the corresponding edge of the terminal module 130. As can be seen in FIGS. 11 and 13, each of the respective board mounting portions 152 is surrounded by a "finger" 138*a* or 138*b* of web material. The fingers 138*a*,138*b* interleaf with one another when the half-modules 131,133 are assembled into module 130. As best seen in FIG. 11, at least one of the half-modules includes a pair of posts 135 and at least one includes a pair of complementary apertures 137 used to secure the two half-modules together. At least the outer surface of half-module 131 further includes a recessed portion and a protrusion 139 extending outwardly therefrom for cooperating with shield 160 as more fully explained below.

Figure 14:
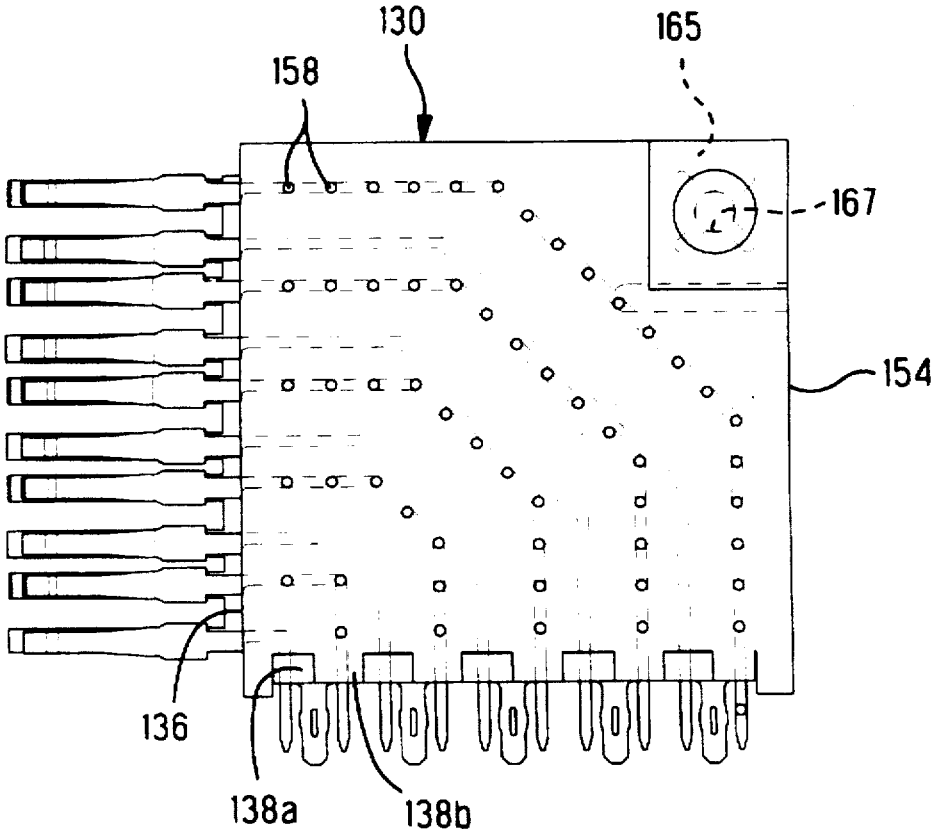
FIG. 14 is a side plan view of the assembled module and ground shield of FIG. 12.

As previously discussed the right angled configuration of the terminal module 130, results in the intermediate contact portions 150 having different lengths, which results in the contacts having different capacitances. To adjust the capacitance of the respective contacts and compensate for the different lengths, web 154 is provided with a plurality of holes 158 extending through the web along the surface of the intermediate portion 150 of each contact as illustrated in FIG. 14. Further to achieve the desired electrical characteristics for the assembled module 130, the half-modules 131,133 when assembled together have an air pocket between them. It is to be noted that the board connecting portions 152 lie in a common plane even though the corresponding intermediate portions 150 and mating portions 146 do not lie in the same plane.

Figure 15:
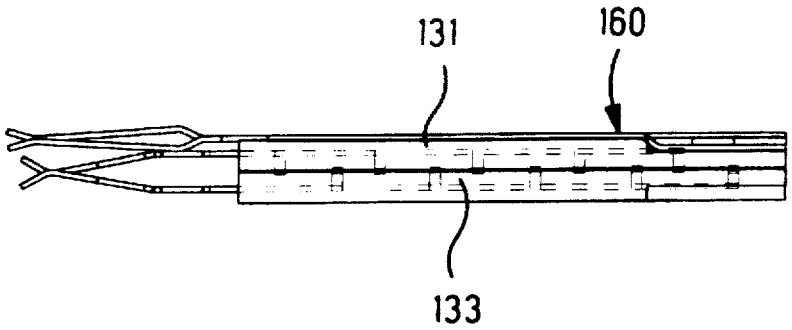
FIG. 15 is a plan view of the top of the shielded module of FIG. 14.

Referring now to FIGS. 14 and 15, ground shield 160 is a substantially planar member similar to shield 60 previously described. Shield 160 has a contact mating portion 162 comprising a plurality of cantilevered arms formed having contact surfaces 164 thereon, a planar body member 166 and a plurality of board mounting sections 168 extending along board mounting edge thereof. Ground shield 160 is dimensioned to be placed between adjacent terminal modules 130 as previously described. In the embodiment shown, shield 160 includes a recessed corner portion 165 having an aperture 167 extending therethrough and adapted to be secured to post 139 of half module 131. Ground shield 160 may be secured to the assembled module or alternatively, shield 160 may be attached to half-module 131 prior to adding second half-module 133 to form the shielded module 130. FIG. 7 is a top view of the assembled module 130 of FIG. 6 with ground shield 160 mounted thereto. The terminal modules 130 and ground shields 160 are then assembled side by side to the back of housing modules 112 as previously described.

Figure 16:
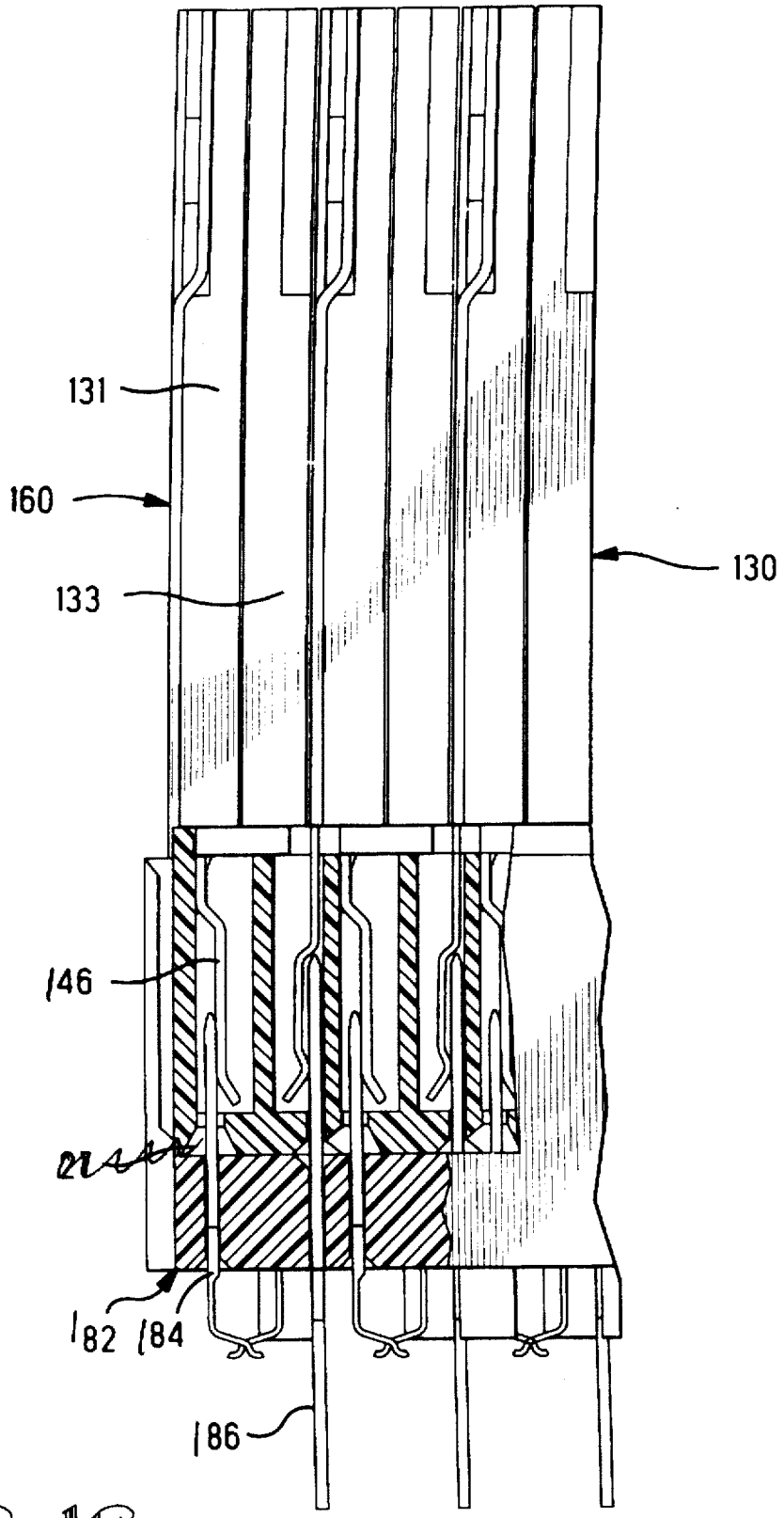
FIG. 16 is a top plan view of the receptacle connector of FIG. 9 partially broken away and illustrating the signal and ground contact mating portions being mated by complementary contacts of a mating connector.

FIG. 16 illustrates a fragmentary portion of a connector housing 112 wherein the signal pins 184 of a mating connector 180 engage respective contact mating portions 146 of the signal contacts 140 and the respective ground tabs 186 of the mating connector 180 engage the contact mating portion 62 of the ground contact as previously described with connector embodiment 10. As can be seen by these Figures the mating portion 146 of signal contact 140 is closely spaced to an associated ground shield 160 and is more closely associated with shield 160 than with the corresponding signal contact 140 that is adjacent to it in the terminal module 130.

It is thought that the connector assembly with terminal modules and ground shields of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. An electrical connector assembly comprising an insulating housing and assembled thereto a plurality of terminal modules and electrically conductive ground shields therebetween, each terminal module having a plurality of signal contacts, each contact including a mating contact portion, a conductor connecting portion and an intermediate portion therebetween with at least some of the intermediate portions encapsulated in an insulative web, each of the modules having an electrically conductive ground shield mounted thereto, the connector assembly being characterized in that:

each terminal module includes first and second signal contacts, the intermediate portions of said first signal contacts being disposed in a first common vertical plane and the intermediate portions of said second contacts being disposed in a second common vertical plane spaced horizontally from said first vertical plane and parallel therewith, the intermediate portions of said first signal contacts being encapsulated in the insulating web proximate a first major side surface of the module and spaced from an opposed second major surface thereof and the intermediate portions of said second signal contacts being encapsulated in the web proximate said second major surface of said module and spaced from said first major surface thereof; and said mating contact portions of said first contacts are staggered vertically with respect to those of said second contacts;

whereby upon assembling the terminal modules and the respective conductive ground shields therebetween into the insulating housing, said intermediate portions of said first signal contacts are spaced more closely to a first said conductive ground shield along said first major surface and said intermediate portions of said second signal contacts are spaced more closely to a second said conductive ground shield along said second major surface thereby assuring primary coupling between each said signal contact and a respective said conductive ground shield rather than to an adjacent said signal contact.

2. The connector assembly of claim 1 wherein each said terminal module is comprised of complementary half-modules that are secured together by fastening portions, each half module including a plurality of one of said first and second signal contacts.

3. The connector assembly of claim 2 wherein said fastening portions include complementary posts and apertures disposed opposed surfaces of said first and second half-modules.

4. The electrical connector assembly of claim 1 wherein said conductor connecting portions of said first contacts and said second contacts lie essentially in the same plane.

5. An electrical connector assembly including a plurality of adjacently disposed terminal modules, and a plurality of electrically conductive ground shields disposed therebetween;

each terminal module comprising:

a plurality of first and second signal contacts, each signal contact having a mating contact portion, a conductor connecting portion and an intermediate portion therebetween, and an insulative web encapsulating at least a portion of the intermediate portions of said first and second signal contacts, said web having opposed first and second major surfaces;

said intermediate portions of said first signal contacts being disposed in a first common vertical plane and the intermediate portions of said second contacts being disposed in a second common vertical plane spaced horizontally from said first vertical plane and parallel therewith, the intermediate portions of said first signal contacts being encapsulated in the insulating web proximate said first major side surface thereof and the intermediate portions of said second signal contacts being encapsulated in the web proximate said second major surface, said intermediate portions of adjacent first and second signal contacts being spaced further from each other than from the surface of said web; and said mating contact portions of said first contacts are staggered vertically with respect to those of said second contacts;

whereby upon assembling said terminal modules and the respective conductive ground shields therebetween into the connector assembly, said intermediate portions of said first signal contacts are spaced more closely to a first said conductive ground shield along said first major surface and said intermediate portions of said second signal contacts are spaced more closely to a second said conductive ground shield along said second major surface thereby assuring primary coupling between each said signal contact and a respective said conductive ground shield rather than to an adjacent said signal contact.

6. The connector assembly of claim 5 wherein each said terminal module is comprised of complementary half-modules that are secured together by fastening portions, each half module including a plurality of one of said first and second signal contacts.

7. The connector assembly of claim 5 wherein said fastening portions include complementary posts and apertures disposed opposed surfaces of said first and second half-modules.

8. The electrical connector assembly of claim 5 wherein said conductor connecting portions of said first contacts and said second contacts lie essentially in the same plane.

9. An electrical connector assembly comprising an insulating housing and assembled thereto a plurality of terminal modules and electrically conductive ground shields therebetween, each terminal module having a plurality of signal contacts, each contact including a mating contact portion, a conductor connecting portion and an intermediate portion therebetween with at least some of the intermediate portions encapsulated in an insulative web, each of the modules having an electrically conductive ground shield mounted thereto, the connector assembly being characterized in that:

each terminal module includes complementary first and second half-modules and first and second signal contacts, the intermediate portions of said first signal contacts being disposed in a first common vertical plane and encapsulated in the insulating web of said first half-module defining a first major side surface of the module and the intermediate portions of said second signal contacts being disposed in a second common vertical plane spaced horizontally from said first vertical plane and parallel therewith, and encapsulated in the web of said second half-module defining said second major surface of said module;

whereby upon assembling and securing respective ones of the first and second terminal half-modules together by engaging complementary fastening portions to form respective terminal modules and disposing respective said conductive ground shields between adjacent modules and inserting them into the insulating housing, said intermediate portions of said first signal contacts are spaced more closely to a first said conductive ground shield along said first major surface and said intermediate portions of said second signal contacts are spaced more closely to a second said conductive ground shield along said second major surface thereby assuring primary coupling between each said signal contact and a respective said conductive ground shield rather than to an adjacent said signal contact.

10. The connector assembly of claim 9 wherein said half-modules are secured together by posts being disposed in complementary apertures disposed on opposed surfaces of said first and second half-modules.

11. The electrical connector assembly of claim 9 wherein said conductor connecting portions of said first contacts and said second contacts lie essentially in the same plane.

12. A method of making a terminal module having a plurality of first and second contacts, each contact having a mating contact portion, a conductor connecting portion and an intermediate portion therebetween, the method including the steps of:

providing a first lead frame having said first contacts;

providing a second lead frame having said second contacts;

overmolding said intermediate portions of said first contacts in said first lead frame with insulating material, such that material forms an insulating web around said intermediate portions of said first contacts sufficiently to hold said intermediate contact positions accurately and stabily in position in a first common plane, and defining a first half-module;

overmolding said intermediate portions of said second contacts in said second lead frame with insulating material, such that material forms an insulating web around said intermediate portions of said second contacts sufficiently to hold said intermediate contact positions accurately and stabily in position in a second common plane, and defining a second half-module; and securing said first and second half-modules together by engaging complementary fastening portions to define said terminal module.

13. The method of claim 12 further including the step of disposing a conduction ground shield along one side of said terminal module defining a shielded terminal module.

14. A method of making an electrical connector including assembling a plurality of terminal modules made in accordance with claim 12 into a housing.

* * * * *